US005799362A

United States Patent [19]

Huffman

[11] Patent Number: 5,799,362

[45] Date of Patent: Sep. 1, 1998

[54] MULTI-USE WATER EXTRACTION CLEANING SYSTEM AND METHOD FOR USING THE SAME

[75] Inventor: Eric C. Huffman, Lowell, Mich.

[73] Assignee: Bissell Inc., Grand Rapids, Mich.

[21] Appl. No.: 693,406

[22] Filed: Aug. 7, 1996

[51] Int. Cl.[6] ..... A47L 7/00

[52] U.S. Cl. ..... 15/321; 15/328

[58] Field of Search ..... 15/321, 328, 320

[56] References Cited

U.S. PATENT DOCUMENTS

| | | | |
|---|---|---|---|
| D. 286,928 | 11/1986 | Fitzwater . | |
| 1,672,983 | 6/1928 | Mapel . | |
| 2,571,575 | 10/1951 | Holmes | 15/321 X |
| 2,963,205 | 12/1960 | Beall, Jr. . | |
| 3,685,694 | 8/1972 | Ianelli . | |
| 3,742,546 | 7/1973 | Crener et al. | 15/320 X |
| 3,896,521 | 7/1975 | Parise | 15/321 |
| 4,244,079 | 1/1981 | Bane | 15/321 |
| 4,295,243 | 10/1981 | King | 15/320 |
| 4,558,484 | 12/1985 | Groth . | |
| 4,559,665 | 12/1985 | Fitzwater . | |
| 4,580,309 | 4/1986 | Ogden | 15/321 X |
| 4,676,287 | 6/1987 | Fitzwater . | |
| 4,910,828 | 3/1990 | Blase et al. . | |
| 5,299,608 | 4/1994 | Bosyj . | |
| 5,400,462 | 3/1995 | Amoretti | 15/321 |

*Primary Examiner*—Chris K. Moore

*Attorney, Agent, or Firm*—Rader, Fishman, Grauer & McGarry

[57] ABSTRACT

The invention comprises a cleaning apparatus having interchangeable cleaning solution supply reservoirs, a fluid pump, a vacuum fan, and a removable recovery tank, all cooperatively arranged in a housing of a unique compact design. The cleaning apparatus also includes a hose having separate hand tools which can be adapted for use on appropriate surfaces. Because different cleaning applications require a different cleaning solution to be supplied through the cleaning solution supply reservoir, each interchangeable cleaning solution bottle contains a cleaning solution appropriate for a particular cleaning application. The supply bottles can be quickly and easily changed so that the user may conveniently and efficiently switch between various cleaning applications. This process has the advantage that unused cleaning solution does not need to be disposed of or stored when switching to a cleaning application that requires a different cleaning solution.

7 Claims, 2 Drawing Sheets

MULTI-USE WATER EXTRACTION CLEANING SYSTEM AND METHOD FOR USING THE SAME

BACKGROUND OF THE INVENTION

1. Field of the Invention

This invention relates to water extraction cleaning machines and, more particularly, to water extraction cleaning machines with interchangeable cleaning solution supply reservoirs to accommodate differing applications of the machine.

2. Description of the Related Art

Water extraction cleaning machines are used for cleaning a variety of surfaces including carpet, upholstery, bare floors, and windows. The cleaning process comprises the steps of directing a water and cleaning solution spray at the surface to be cleaned and then applying a vacuum to remove at least a portion of the solution mixture along with dirt entrained in the solution.

In a typical water extraction cleaning machine, flexible vacuum and cleaning solution hoses extend from the machine housing which supports a vacuum motor, a single cleaning solution supply reservoir, a solution pump, and a dirty water reservoir. A variety of tools or attachments have been developed for coupling to the terminal end of the flexible vacuum and solution hoses for various cleaning applications. For example, one known accessory tool comprises a floor engaging cleaning tool having a fan-shaped suction nozzle fluidly connected to the vacuum hose and a cleaning fluid spray nozzle fluidly connected to the cleaning solution hose. Another known tool is an upholstery cleaning tool, again having a fan-shaped suction nozzle and a fluid spray nozzle.

One problem with the known various multi-use water extraction cleaning machines is the limitation inherent in a single supply tank design. Switching applications often requires switching cleaning solutions. When the user desires to switch from upholstery cleaning to window cleaning, the floor cleaning solution in the supply tank must be disposed of or emptied into a storage container, and the supply tank is then refilled with the window cleaning solution. This process of emptying the supply tank of one solution and refilling the tank with another solution is inefficient and inconvenient to the user.

SUMMARY OF THE INVENTION

The multi-use water extraction cleaning system according to the invention overcomes the problems with the prior art by providing interchangeable cleaning solution supply bottles which can be filled with appropriate cleaning solutions for different cleaning applications and mounted in the machine for nearly instantaneous conversion between different applications. The supply bottles can be quickly and easily changed so that the user may conveniently and efficiently switch between various cleaning applications. This process has the advantage that the unused cleaning solution does not need to be disposed of or stored when switching to a cleaning application that requires a different cleaning solution.

The invention comprises a cleaning apparatus having interchangeable cleaning solution supply reservoirs, a fluid pump, a vacuum fan, and a removable recovery tank, all cooperatively arranged in a housing. The cleaning apparatus also includes a hose having two or more separate hand tools which can be adapted for use on appropriate surfaces. For example, one tool can be a floor or upholstery cleaning tool having a fan-shaped suction nozzle and a fluid spray nozzle. Another tool can be a window washing tool having an applicator pad, a squeegee blade, a fluid spray nozzle, and a vacuum suction nozzle. Upholstery cleaning and window cleaning each require a different cleaning solution to be supplied through the cleaning solution supply reservoir. Accordingly, two or more interchangeable cleaning solution bottles are provided, each containing a cleaning solution appropriate for a particular cleaning application.

By using the multi-use cleaning system of the present invention, convenience and efficiency are greatly enhanced. The ability to change hand tools depending on the application greatly enhances the convenience and efficiency of using the cleaning apparatus for various cleaning applications. This benefit is enhanced through the ability to quickly and easily alternate between cleaning solutions depending on the cleaning application to be performed. This system also has the benefit of reducing cleaning solution waste as the machine is switched between different uses. These and other objects, advantages, and features of the present invention will be more fully understood and appreciated by reference to the written specification and appended drawings.

BRIEF DESCRIPTION OF THE DRAWINGS

The invention will now be described with reference to the drawings in which.

DETAILED DESCRIPTION OF THE PREFERRED EMBODIMENTS

Figure 1:
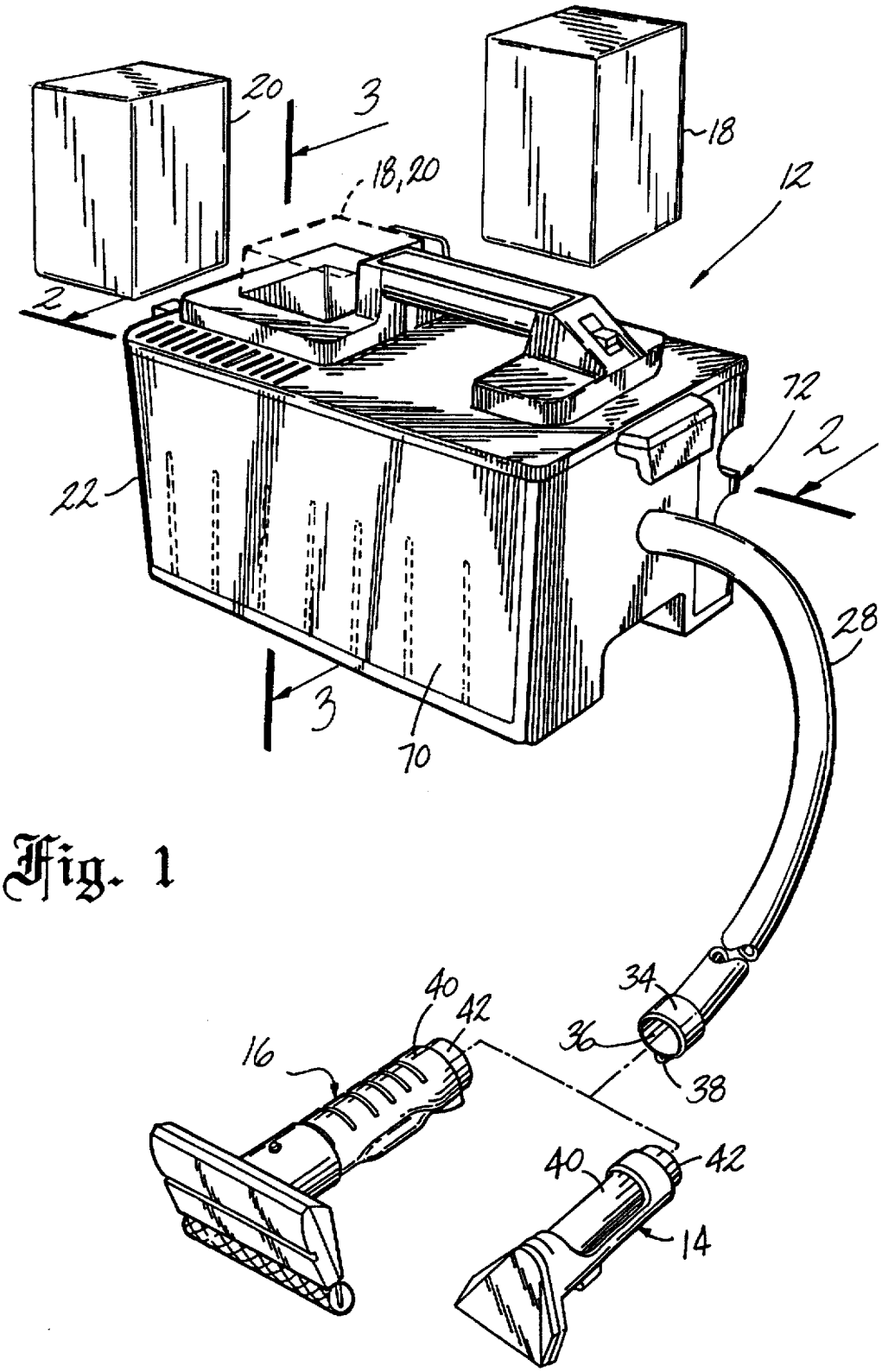
FIG. 1 is a perspective view of a water extraction cleaning system incorporating interchangeable supply tanks and interchangeable cleaning tools such as a floor/upholstery cleaning tool and a window washing cleaning tool according to the invention.
Figure 2:
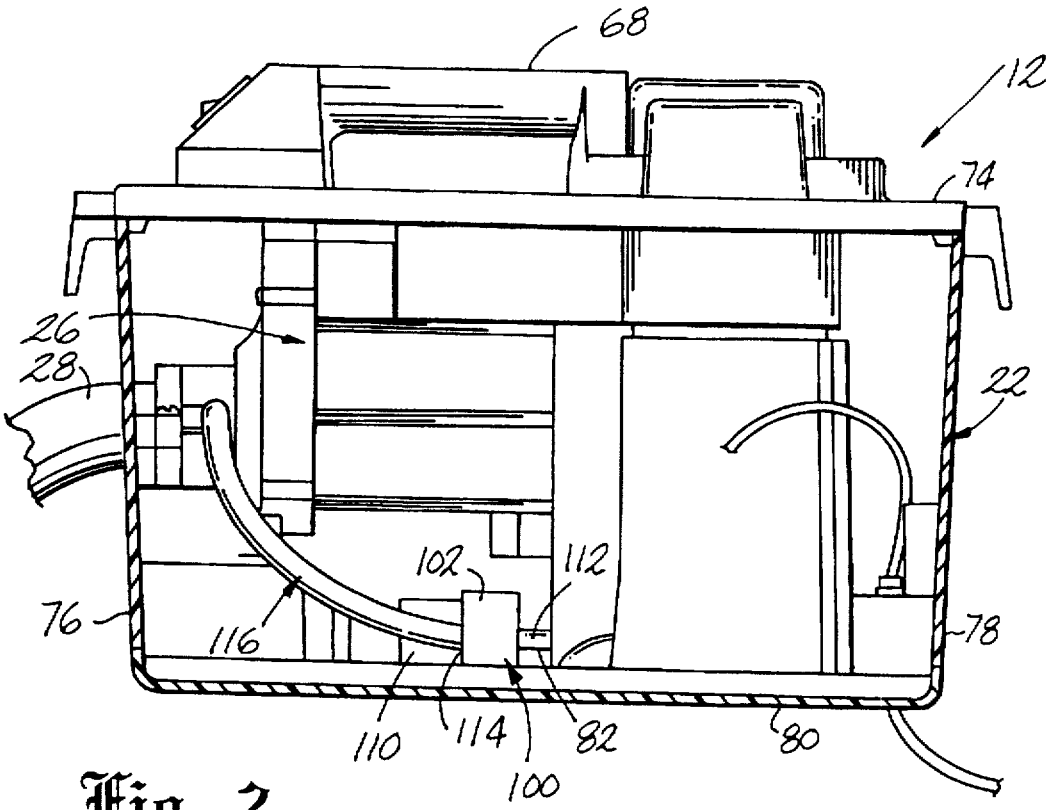
FIG. 2 is a cross-sectional view taken along lines II—II in FIG. 1.
Figure 3:
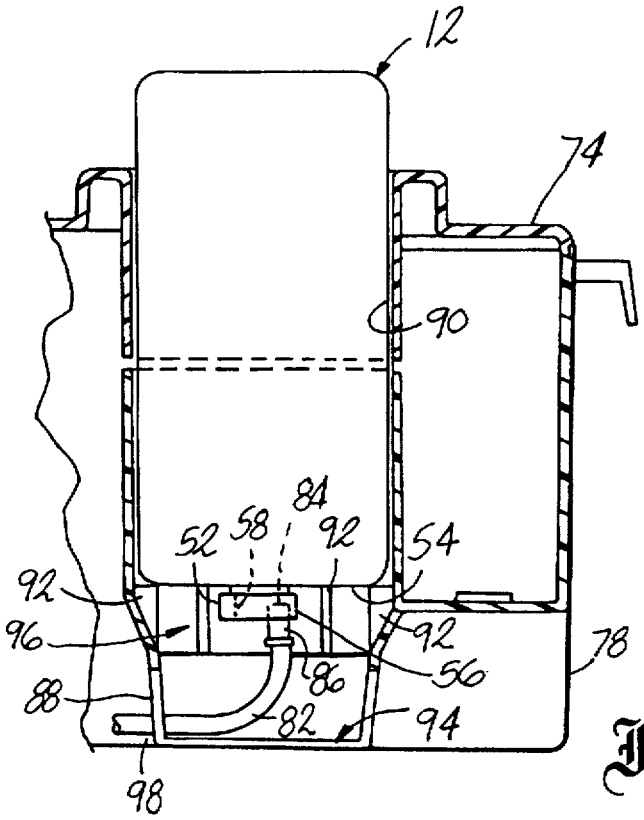
FIG. 3 is a fragmentary cross-sectional view taken along lines III—III in FIG. 1.

Referring now to the drawings and to FIGS. 1–3 in particular, the water extraction cleaning system comprises a cleaning machine 12, a floor/upholstery cleaning tool 14, a window washing cleaning tool 16, two or more interchangeable cleaning solution bottles 18, 20, and a flexible hose 28 extending from a housing 22 to receive at least one of a plurality of tools 16, 18. The housing 22 is rectangular in configuration and comprises front and rear walls 76,78, a pair of opposing side walls 70, 72, and top and bottom walls 74, 80. To enhance the portability and manipulability of cleaning machine 12, the top wall 74 is provided with an easily grasped hand grip 68 located centrally thereon. Located within the housing 22 in a compact and efficient manner is a vacuum motor 26, a removable dirty solution recovery tank (not shown), a receiving well 90, and a fluid pump 100. The receiving well 90 matingly receives one of the cleaning solution supply bottles 18, 20. A more complete description of the structural details of a water extraction cleaning machine within the scope of the invention illustrated in FIG. 1 is found in U.S. Pat. No. 4,910,828, issued Mar. 27, 1990 to Blase et. al. which is expressly incorporated herein by reference. A more complete description of window washing cleaning tool 16 which can be mounted on the hose is found in U.S. patent application Ser. No. 08/683,608 which is expressly incorporated herein by reference.

As shown in FIG. 1, one end of the hose 28 is secured to the housing 22, and the other end of the hose 28 has an end fitting 34 provided thereon having a working air passage 36 and a male solution fitting 38 extending therefrom. The male solution fitting 38 is in fluid communication with the solution conduit of flexible hose 28.

Each tool 14, 16 has a grip tube 40 selectively mounted to the end fitting 34 of the hose 28. Each grip tube 40 includes a collar 42 formed on one end of the tube 28 wherein the collar 42 is adapted to be telescopically received inside the working air passage 36 of the end fitting 34 and a female solution fitting (not shown) which is adapted to telescopically receive the male solution fitting 38 of the end fitting 34. Similarly, a flexible solution conduit (not shown) extends the length of each grip tube 40 selectively interconnecting the female solution fitting (not shown) adjacent the collar 42 and the male solution fitting 38. A trigger is incorporated into either the tool or the hose for controlled distribution of the solution.

The floor/upholstery cleaning tool 14 and the window washing tool 16 are quickly and easily mounted to and dismounted from the grip tube 40. An aperture (not shown) provided on the end fitting 34 is adapted to receive a conventional, flexible, biased, locking tab (not shown) provided on the grip tube 40 for securing the window washing tool 16 or the floor/upholstery cleaning tool 14 to the grip tube 40. When it is desired to remove the upholstery/floor cleaning tool 14 or window washing tool 16 from the grip tube 40, the user merely depresses the locking tab and slides the respective tool 14, 16 longitudinally, away from the grip tube 40.

The cleaning solution bottles 18, 20, which are separate, removable, interchangeable reservoirs for containing different cleaning solutions, can be removed and replaced with the other as needed. Each bottle may be removed and replaced regardless of the quantity of fluid contained therein. The bottles 18, 20 are identical in shape, preferably an elongated, rectangularly-shaped container having a head 52 at one end 54, as best illustrated in FIG. 3. The head 52 is substantially cylindrical in shape (although any desired shape could be utilized) and includes along its distal surface a spout 56 and a small diameter vent opening 58. The spout 56 is provided to affect the coupling of the container 18, 20 to the hose 82 stationed within the housing 22. In the preferred embodiment, the spout 56 is recessed within the head 52 and circumscribed by a recess 84 into which a polymeric or rubber coupling 86 of the hose 82 is inserted for connection with the spout 56. This construction provides an easily connectable coupling arrangement which is not susceptible to subsequent inadvertent disconnection. The vent opening 58 is provided to vent air into the bottle 18, 20 during the operation of cleaning machine 12 as the cleaning solution exits the respective bottle 18, 20. A tube (not shown) inside the dispensing bottle 18, 20 extends from the vent opening 58 to the bottom (or top when inverted) thereof and a small ball check valve (not shown) is located within the vent opening 58 to prevent inadvertent fluid flow therethrough.

In operation, one of the interchangeable cleaning solution bottles 18 and 20 is received with its head 52 projecting downwardly into a receiving well 90 in the housing 22 as illustrated in phantom in FIG. 1. The receiving well 90 is of a shape to matingly receive one of the cleaning solution bottles 18, 20 therein so that no rattling or dislodging occurs. Along the periphery of the lower portion of the receiving well 90 are included a plurality of mounting flanges 92 which are adapted to guide the head end 54 of the respective cleaning solution bottle 18,20 for secure positioning thereof. The mounting flanges 92 act to limit the length of bottle which can be received in the well 90.

To facilitate easy set-up of cleaning machine 12, the hose 82 is elongated and has a length which permits the coupling 86 to be extended upwardly beyond the top 74 and out of the well 90. In this orientation, the coupling 86 is easily inserted onto the spout 56 of the respective cleaning solution bottle 18, 20. Once this connection has been accomplished, the respective cleaning solution bottle 18, 20 is inserted with its head 52 down into the receiving well 90 as discussed above. No leakage of the cleaning solution occurs from the cleaning solution bottle 18, 20 due to the fluid-type connection affected by the coupling 86, the spout element 56, and the small diameter of vent opening 58.

The hose 82 exits through an opening 98 in a side 88 of the well 90 and connects with a conventional fluid pump 100. More specifically, the fluid pump 100 includes a small impeller (not shown) in the casing 102 which is preferably powered by a small low voltage DC motor 110. The casing 102 includes an inlet port 112 on one end thereof which facilitates connection with the hose 82 and on its other end, laterally spaced therefrom, an exit port 114 which facilitates connection with a supply conduit 116.

The supply conduit 116 is utilized to conduct the pressurized cleaning solution to the cleaning tool for distribution onto the surface to be cleaned. To effect this operation, the supply conduit 116 is received within the vacuum hose 28 and extends therethrough the entire length until reaching a dispersing nozzle (not shown) located in the attached hand tool 14 or 16.

The invention centers around the cleaning system adapted to use multiple, different cleaning solutions for different applications. In cleaning machines, such as those described above wherein a premixed water and cleaning detergent solution is provided in a single container, switching between different applications which required different cleaning solution mixtures is difficult. The system according to the invention overcomes these problems by providing separate containers for the differing solution mixtures. In the preferred embodiment described above, each solution is adapted for a different use with a different accessory cleaning tool. However, the use of differing tools is not necessarily required for the invention. For example, multiple cleaning solution supply reservoirs could be provided with differing concentrations of detergent contained therein, depending upon use of the system for cleaning heavily soiled areas or merely using a clean water rinse.

As water extraction cleaning machines are being adapted for a wider variety of uses, the ability to quickly and efficiently convert the machine between such different uses without wasting expensive cleaning detergents becomes more valuable to the consumer.

Reasonable variation and modification are possible within the spirit of the foregoing specification and drawings without departing from the scope of the invention.

The embodiments for which an exclusive property or privilege is claimed are defined as follows:

1. A multi-use water extraction cleaner system comprising:

at least two cleaning solution supply reservoirs, each having a unique cleaning solution contained therein;

a water extraction cleaning machine comprising:

a housing;

a solution pump provided in the housing for generating a supply of pressurized cleaning solution;

a solution conduit fluidly connected to the solution pump, the conduit having proximal and distal ends;

a vacuum motor provided in the housing for generating working air flow;

an accessory hose fluidly connected to the vacuum motor and having proximal and distal ends;

a dirty water reservoir provided in the housing adapted to receive from the accessory hose, the working air flow generated by the vacuum motor; and a cleaning solution reservoir mounting provided in the housing; and at least one cleaning tool adapted to be fluidly connected to both the accessory hose and the solution conduit, wherein the water extraction cleaning machine can be quickly converted between a first application using a first of said at least two cleaning solution supply reservoirs to a second application using a second of said at least two cleaning solution supply reservoirs by removing said first supply reservoir from the reservoir mounting and substituting the second therefor.

2. A multi-use water extraction cleaner system according to claim 1 wherein the at least one cleaning tool comprises a window washing tool.

3. A multi-use water extraction cleaner system according to claim 1 wherein said at least one cleaning tool comprises two cleaning tools.

4. A multi-use water extraction cleaner system according to claim 3 wherein one of the tools comprises a window washing tool and one of said at least two cleaning solution supply reservoirs contains a window washing cleaning solution.

5. A multi-use water extraction cleaner system according to claim 4 wherein another of the tools comprises a carpet cleaning tool and another of said at least two cleaning solution supply reservoirs contains a carpet cleaning solution.

6. A multi-use water extraction cleaner system according to claim 4 wherein another of the tools comprises an upholstery cleaning tool and another of said at least two cleaning solution supply reservoirs contains an upholstery cleaning solution.

7. A multi-use water extraction cleaner system comprising:

two cleaning solution supply reservoirs, a first reservoir having carpet cleaning solution contained therein and a second having a window cleaning solution contained therein;

a water extraction cleaning machine comprising:

a housing;

a solution pump provided in the housing for generating a supply of pressurized cleaning solution;

a solution conduit fluidly connected to the solution pump, the conduit having proximal and distal ends;

a vacuum motor provided in the housing for generating working air flow;

an accessory hose fluidly connected to the vacuum motor and having proximal and distal ends;

a dirty water reservoir provided in the housing adapted to receive from the accessory hose, the working air flow generated by the vacuum motor; and a cleaning solution reservoir mounting provided in the housing;

a carpet cleaning tool adapted to be selectively, fluidly connected to both the accessory hose and the solution conduit; and a window washing tool adapted to be selectively, fluidly connected to both the accessory hose and the solution conduit, wherein the water extraction cleaning machine can be quickly converted between a first application using the carpet cleaning tool and said carpet cleaning solution to a second application using the window washing tool and said window washing solution, and vice versa, by selectively mounting the window washing tool and window washing cleaning solution reservoir to the machine.

* * * * *